United States Patent [19]

Fujimoto

[11] Patent Number: 4,966,113

[45] Date of Patent: Oct. 30, 1990

[54] REVERSE ROTATION PREVENTING DEVICE FOR DIESEL ENGINE

[75] Inventor: Yoshiaki Fujimoto, Himeji, Japan

[73] Assignee: Kabushiki Kaisha Kobe Seiko Sho, Kobe, Japan

[21] Appl. No.: 438,026

[22] Filed: Nov. 20, 1989

[51] Int. Cl.[5] ..... F02B 77/08; F02D 31/00; F02M 63/02

[52] U.S. Cl. ..... 123/359; 123/198 DB

[58] Field of Search ..... 123/352, 357, 359, 198 D, 123/198 DB

[56] References Cited

U.S. PATENT DOCUMENTS

| | | | |
|---|---|---|---|
| 4,212,278 | 7/1980 | Eisinger et al. | 123/198 DB |
| 4,296,718 | 10/1981 | Baugh et al. | 123/198 DB |
| 4,388,900 | 6/1983 | Hoshi | 123/198 DB |
| 4,509,480 | 4/1985 | Kull et al. | 123/198 DB |
| 4,565,170 | 1/1986 | Grieshaber et al. | 123/198 DB |

FOREIGN PATENT DOCUMENTS

| | | | |
|---|---|---|---|
| 0047630 | 4/1981 | Japan | 123/359 |

*Primary Examiner*—Willis R. Wolfe

*Attorney, Agent, or Firm*—Oblon, Spivak, McClelland, Maier & Neustadt

[57] ABSTRACT

A reverse rotation preventing device for a diesel engine which can stop, when the engine exhibits a stopping tendency, operation of the engine to prevent reverse rotation of the engine with certainty and can automatically release a stopping interlock after stopping of the engine. The device comprises an engine stopping mechanism, an engine speed detecting mechanism, a comparing mechanism for comparing a detection value developed from the engine speed detecting mechanism with a reference value which is set in advance as a low engine speed with which stopping of the engine may be resulted, a judging mechanism for judging in accordance with the detection value whether or not the engine is in a deceleration tendency, an outputting mechanism for outputting an engine stopping signal to the engine stopping mechanism when the detection value is lower than the reference value and the engine is in a deceleration tendency, and a timer mechanism for interrupting the outputting of the engine stopping signal after lapse of a predetermined interval of time.

1 Claim, 5 Drawing Sheets

REVERSE ROTATION PREVENTING DEVICE FOR DIESEL ENGINE

BACKGROUND OF THE INVENTION

1. Field of the Invention

This invention relates to a reverse rotation preventing device for a Diesel engine for use with a construction equipment such as a hydraulic shovel or a hydraulic crane.

2. Description of the Prior Art

In a construction equipment wherein a hydraulic pump is driven by a Diesel engine, when the load to the pump increases beyond the torque of the engine, the engine is sometimes reversed, which may give rise to seizure of or damage to the engine.

Conventionally, reverse rotation preventing devices for a Diesel engine are roughly divided into two types including a first type wherein a stopping signal for an engine is developed after occurrence of reverse rotation of the engine and a second type wherein a stopping signal for an engine is developed upon stopping of forward rotation of the engine, that is, immediately before starting of reverse rotation of the engine. An exemplary one of known reverse rotation preventing devices of the former type includes a check valve (butterfly valve) interposed, for example, in an intake air passage of the engine for closing the intake air passage when the flow of air is reversed by reverse rotation of the engine. On the other hand, an exemplary one of known reverse rotation preventing devices of the latter type is constituted such that, when, for example, forward rotation of the engine is stopped, an actuating solenoid for an engine stopping lever is energized to operate the lever to stop the engine in response to an action of a pressure switch provided for detecting a pressure of lubricating oil of the engine.

However, with the reverse rotation preventing device of the former type, since reverse rotation itself of the engine is detected, the anticipated object of prevention of reverse rotation of the engine cannot substantially be attained. On the other hand, also with the reverse rotation preventing device of the latter type, reverse rotation actually takes place because there is some time lag or delay in response between a point of time when the engine is stopped and another point of time when such stopping of the engine is detected.

Where the reverse rotation preventing device of the latter type is constituted such that, each time forward rotation of the engine is stopped, the engine is interlocked in an engine operation stopping condition, means are required for releasing such interlock when the engine is to be subsequently started. For example, where the interlock is provided by operation of such an actuating solenoid for an engine stopping lever as described above, it is necessary to additionally provide a circuit for deenergizing the solenoid in response to a starting signal of the key switch of the engine. Consequently, the reverse rotation preventing device is complicated in construction and is thus deteriorated in reliability as much. Further, since the solenoid is kept in an energized condition during such interlock, several disadvantages such as the discharge of a battery, the deterioration of the life of the solenoid, and so forth are created.

SUMMARY OF THE INVENTION

It is an object of the present invention to provide a reverse rotation preventing device for a Diesel engine which can stop, when the engine exhibits a stopping tendency, operation of the engine to prevent reverse rotation of the engine with certainty and can automatically release a stopping interlock after stopping of the engine.

In order to attain the above object, according to the present invention, there is provided a reverse rotation preventing device for a Diesel engine, which comprises an engine stopping means for stopping the engine, and engine speed detecting means for detecting a speed of the engine, a comparing means for comparing a detection value developed from the engine speed detecting means with a reference value which is set in advance as a low engine speed with which stopping of the engine may be resulted, a judging means for judging in accordance with the detection value from the engine speed detecting means whether or not the engine is in a deceleration tendency, an outputting means operable in accordance with a result of the judgment by the judging means and a result of the comparison by the comparing means for outputting an engine stopping signal to the engine stopping means when the detection value is lower than the reference value and the engine is in a deceleration tendency, and a timer means for interrupting the outputting of the engine stopping signal after lapse of a predetermined interval of time.

With the reverse rotation preventing device, when the engine speed is reduced below the reference value which is set in advance as the low engine speed with which stopping of the engine may be resulted, operation of the engine is stopped compulsorily. Consequently, reverse rotation of the engine is prevented with certainty. Further, since it is a requirement for compulsory stopping of the engine that the engine is in a deceleration tendency and the stopping interlock of the engine is automatically cancelled after lapse of the predetermined interval of time, a complicated mechanism for releasing the stopping interlock of the engine upon starting of the engine can be eliminated and the reliability of the system is improved. Besides, possible bad effects such as discharge of a battery which may otherwise be caused by the interlock condition which is maintained for a long period of time can be eliminated.

The above and other objects, features and advantages of the present invention will become apparent from the following description and the appended claims, taken in conjunction with the accompanying drawings in which like parts are denoted by like reference characters all through the drawings.

DETAILED DESCRIPTION OF THE PREFERRED EMBODIMENTS

Figure 5:
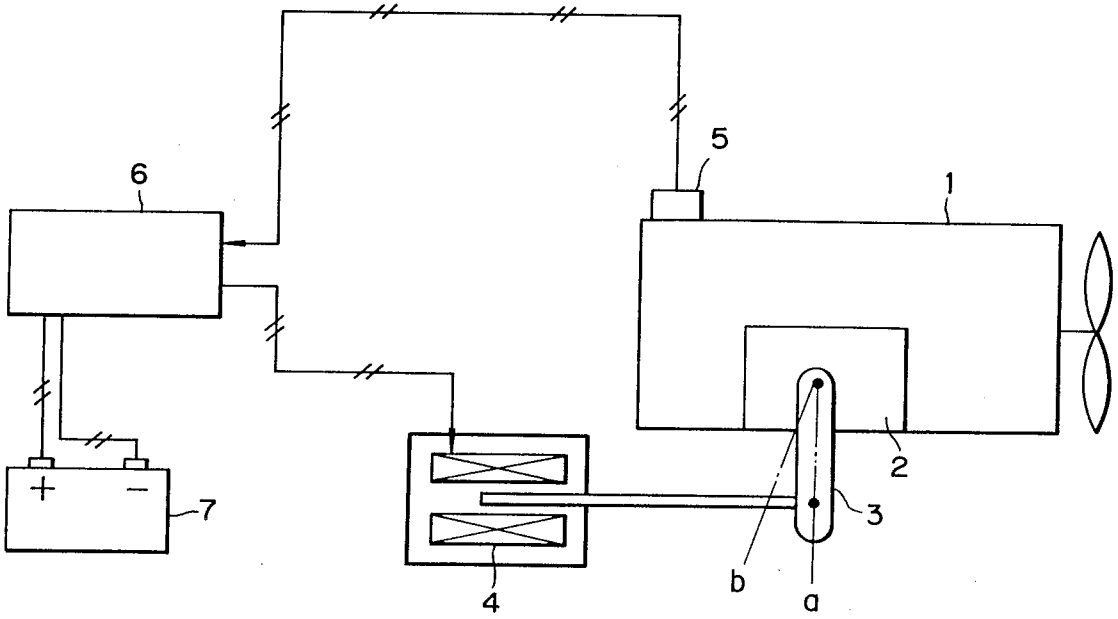
FIG. 5 is a diagrammatic representation of a Diesel engine system in which a reverse rotation preventing device according to the present invention is incorporated.

Referring first to FIG. 5, there is shown a Diesel engine system in which a reverse rotation preventing device according to the present invention is incorporated. The Diesel engine system shown includes a Diesel engine (hereinafter referred to simply as engine) 1, a fuel injection system 2 for the engine 1, an engine stopping lever 3 for operating the fuel injection system 2 to stop the engine 1, and a solenoid 4 for operating the stopping lever 3. When the solenoid 4 is energized, the stopping lever 3 is pulled to move from its engine operating position a to its engine stopping position b to stop the engine 1.

The Diesel engine system further includes a power source 7 in the form of a battery and an engine speed sensor 5 for detecting a rotational speed of the engine 1. A detection signal (detection value) $N_1$ from the sensor 5 is inputted to a controller 6.

Detailed construction and operation of the controller 6 will be described at first with reference to FIGS. 1 and 2 which shows a reverse rotation preventing device of the first preferred embodiment of the present invention and then with reference to FIGS. 3 and 4 which shows a reverse rotation preventing device of the second preferred embodiment of the present invention.

First Embodiment

Figure 1:
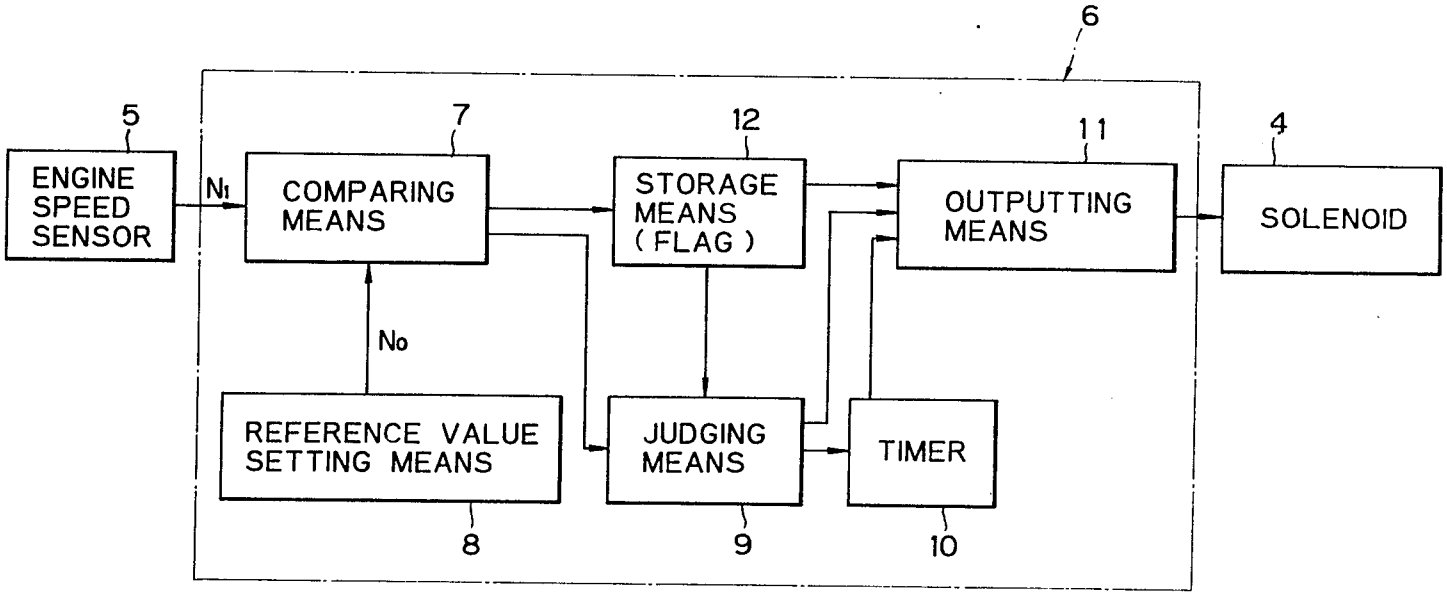
FIG. 1 is a block diagram of a reverse rotation preventing device for a Diesel engine showing a first preferred embodiment of the present invention.

Referring first to FIG. 1, a detection value $N_1$ from the engine speed sensor 5 is inputted to a comparing means 7 of the controller 6. In the comparing means 7, the detection value $N_1$ is compared with a preset reference value $N_0$ which is inputted to the comparing means 7 by way of a reference value setting means 8 as a low engine speed with which stopping of the engine may be resulted. A result of such comparison is inputted to a judging means 9 in which it is judged whether or not the engine speed is in an engine stopping tendency. In case an engine stopping tendency is judged here, a solenoid energizing signal is outputted to an outputting section 11 by way of a timer 10. In any other case, a solenoid deenergizing instruction is outputted directly to the outputting section 11. In response to such solenoid energizing instruction, the outputting section 11 supplies an exciting current as an engine stopping signal to the solenoid 4. On the other hand, when the result of comparison by the comparing means 7 proves that the detection value $N_1$ exceeds the reference value $N_0$ for the first time, a flag $A=1$ is stored into a storage means 12. The flag $A=1$ is used as a parameter for judgment by the judging means 9.

Figure 2:
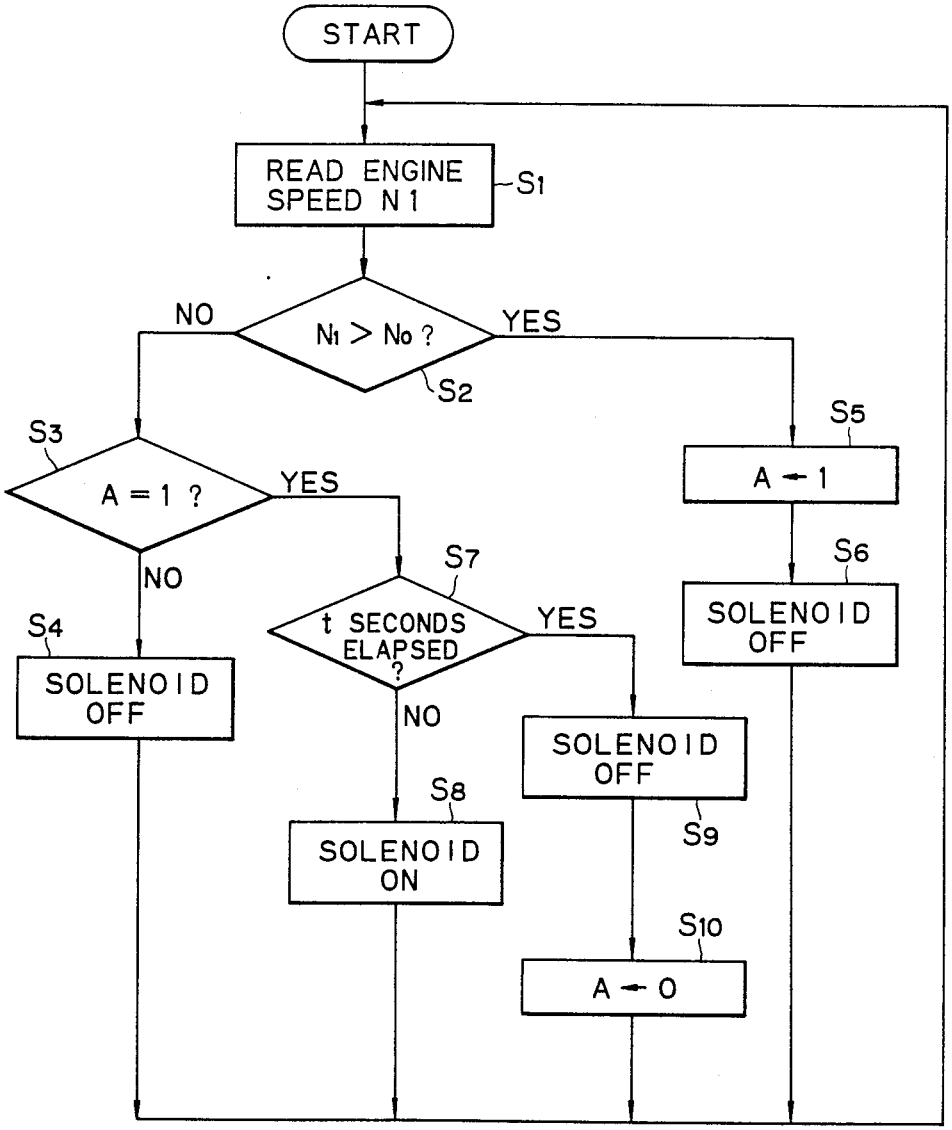
FIG. 2 is a flow chart illustrating operation of the reverse rotation preventing device shown in FIG. 1.

Referring now to FIG. 2, there is illustrated operation of the reverse rotation preventing device shown in FIG. 1. After starting of operation of the reverse rotation preventing device, a detection value $N_1$ of the engine speed is read in from a signal from the engine speed sensor 5 at step $S_1$, and then at step $S_2$, the detection value $N_1$ is compared with the reference value $N_0$. In this instance, when the engine is in a stopping condition, $N_1=0$, and until the engine speed after starting of the engine reaches a normal rotational speed region, the condition of $N_1<N_0$ continues. Consequently, the sequence advances from step $S_2$ to step $S_3$. Then, since the condition of $N_1<N_0$ has net yet reached and the flag A remains $A=0$ at step $S_3$, a solenoid deenergizing instruction is delivered to the outputting section 11 of FIG. 1 at step $S_4$.

Then, if the engine speed $N_1$ exceeds the reference value $N_0$, then the flag $A=1$, that is, the fact that the engine speed $N_1$ has reached the normal rotational speed region once, is stored at step $S_5$. In this instance, however, the solenoid deenergizing instruction is still outputted at step $S_6$.

After then, if the engine speed $N_1$ becomes lower than the reference value $N_0$, now the sequence advances from step $S_3$ by way of step $S_7$ to step $S_8$ at which a solenoid energizing instruction is outputted. The output of such solenoid energizing instruction continues for a preset period of time (t seconds) which is counted by the timer 10 shown in FIG. 1 (step $S_8$) as this is judged at step $S_7$. In response to such solenoid energizing instruction, the solenoid 4 shown in FIG. 5 is energized, and consequently, the stopping lever 3 is pulled to move to the stopping position b to stop the engine 1. The preset time of t seconds at the timer 10 has a sufficient interval of time until the engine 1 comes to a stopping condition with certainty by way of energization of the solenoid 4 and resultant operation of the stopping lever 3 after a point of time at which $N_1<N_2$ was reached.

After the engine 1 is stopped, that is, after the lapse of t seconds, the sequence now advances from step $S_7$ to step $S_9$ at which the solenoid 4 is deenergized, and then to step $S_{10}$ at which the flag A is cleared in preparation for subsequent control of the engine 1.

With the reverse rotation preventing device having such a construction as described above, not stopping of forward rotation or reverse rotation after stopping of the engine is detected as in the conventional devices described above, but it is detected whether or not the engine speed $N_1$ has become lower than the reference value $N_0$ which is set as a low rotational speed with which stopping of the engine may resulted. Accordingly, reverse rotation of the engine 1 can be prevented with certainty. Further, since the reverse rotation preventing device is constituted such that the fact that the engine speed has once reached the normal rotational speed region is stored by way of a flag and when the condition wherein the detection value $N_1$ is smaller than reference value $N_0$, that is, $N_1<N_0$, is reached, it is judged in accordance with the flag information whether or not the engine 1 is in a deceleration tendency (that is, whether or not the engine is in a starting condition), whereby an engine stopping tendency is judged only when the requirement of $N_1<N_0$ and the requirement of a deceleration tendency are both satisfied, and that the interlock of stopping of the engine is automatically released after lapse of the preset interval of time at the timer 10, the engine stopping function does not operate upon starting of the engine. Consequently, there is no necessity of provision of such a mechanism for releasing the interlock upon starting of the engine as in the conventional devices.

Accordingly, the reverse rotation preventing device is simplified in construction and improved in reliability as much. Besides, such bad effects as discharge of the battery, deterioration in life of the solenoid 4 will not take place which may be caused by the interlocking function which is maintained also after stopping of the engine.

Second Embodiment

While the reverse rotation preventing device of the first embodiment described above employs a flag as a means for judging whether the engine is in a deceleration tendency when $N_1 < N_0$, a reverse rotation preventing device of the second embodiment employs means for reading a deceleration tendency from a condition of variation of the engine speed.

Figure 3:
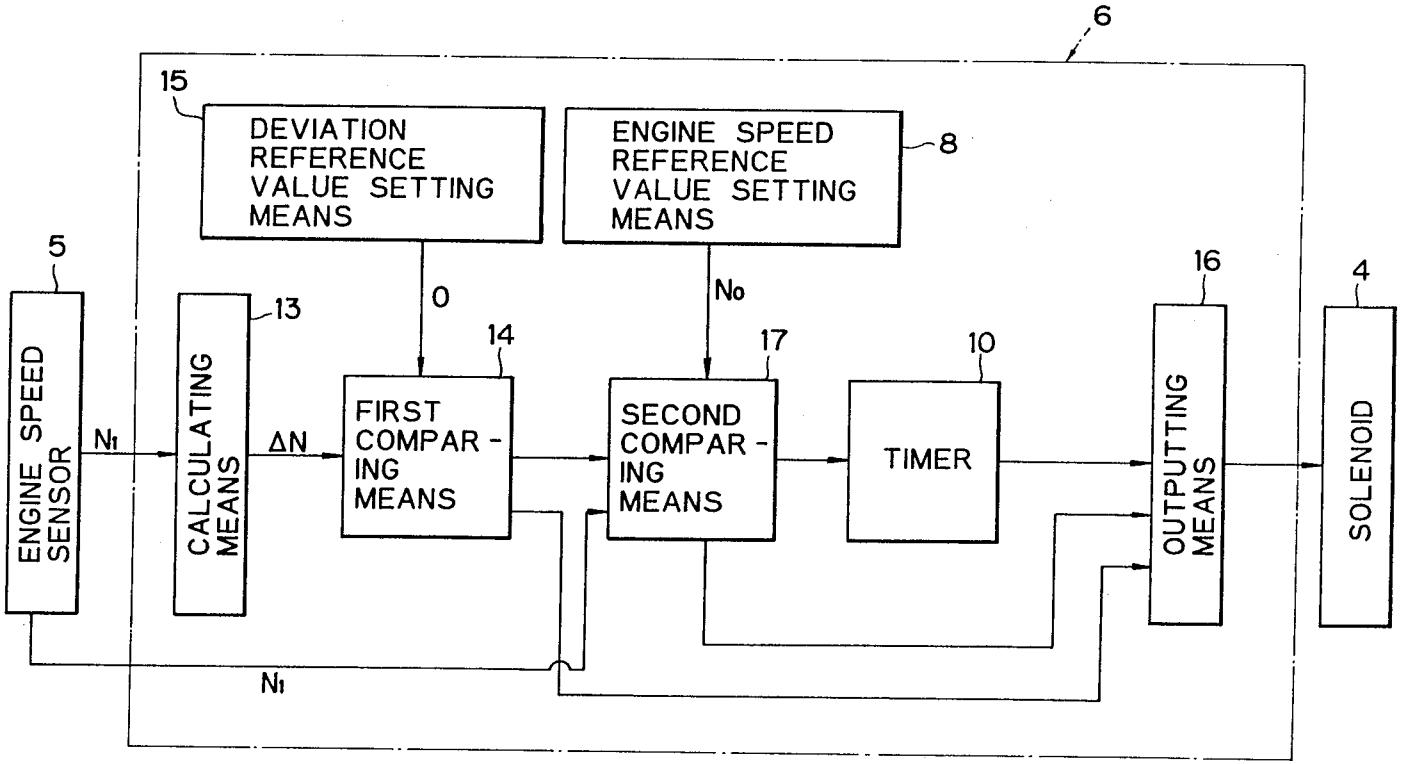
FIG. 3 is a block diagram of another reverse rotation preventing device for a Diesel engine showing a second preferred embodiment of the present invention.

In particular, referring now to FIG. 3, a signal from an engine speed sensor 5 is inputted to a calculating means 13 in which a deviation $\Delta N$ between a preceding detection value $N_1'$ and the present detection value $N_1$ is detected. The deviation $\Delta N$ is inputted to a first comparing means 14 in which it is compared with a reference value 0 set by a deviation reference value setting means 15. In case the result of the comparison reveals that $\Delta N < 1$, that is, the deviation $\Delta N$ has a positive value, rotation of the engine is in an acceleration tendency, but if $\Delta N < 0$, that is, if the deviation $\Delta N$ has a negative value, rotation of the engine is in a deceleration tendency. In the case of an acceleration tendency, a solenoid deenergizing instruction is inputted to an outputting means 16. On the contrary, in case the engine rotation is in a deceleration tendency, the signal is inputted to a second comparing means 17 which corresponds to the comparing means 7 of the reverse rotation detecting device of the first embodiment shown in FIG. 1. In response to the signal, the second comparing means 17 compares the detection value $N_1$ of the engine speed received from the engine speed sensor 5 with a reference value $N_0$ provided by way of an engine speed reference value setting means 8. When the detection value $N_1$ is lower than the reference value $N_0$, a solenoid energizing instruction is inputted to the outputting circuit 16 by way of a timer 10, but on the contrary if $N_1 < N_0$, then a solenoid deenergizing instruction is inputted directly to the outputting circuit 16.

Figure 4:
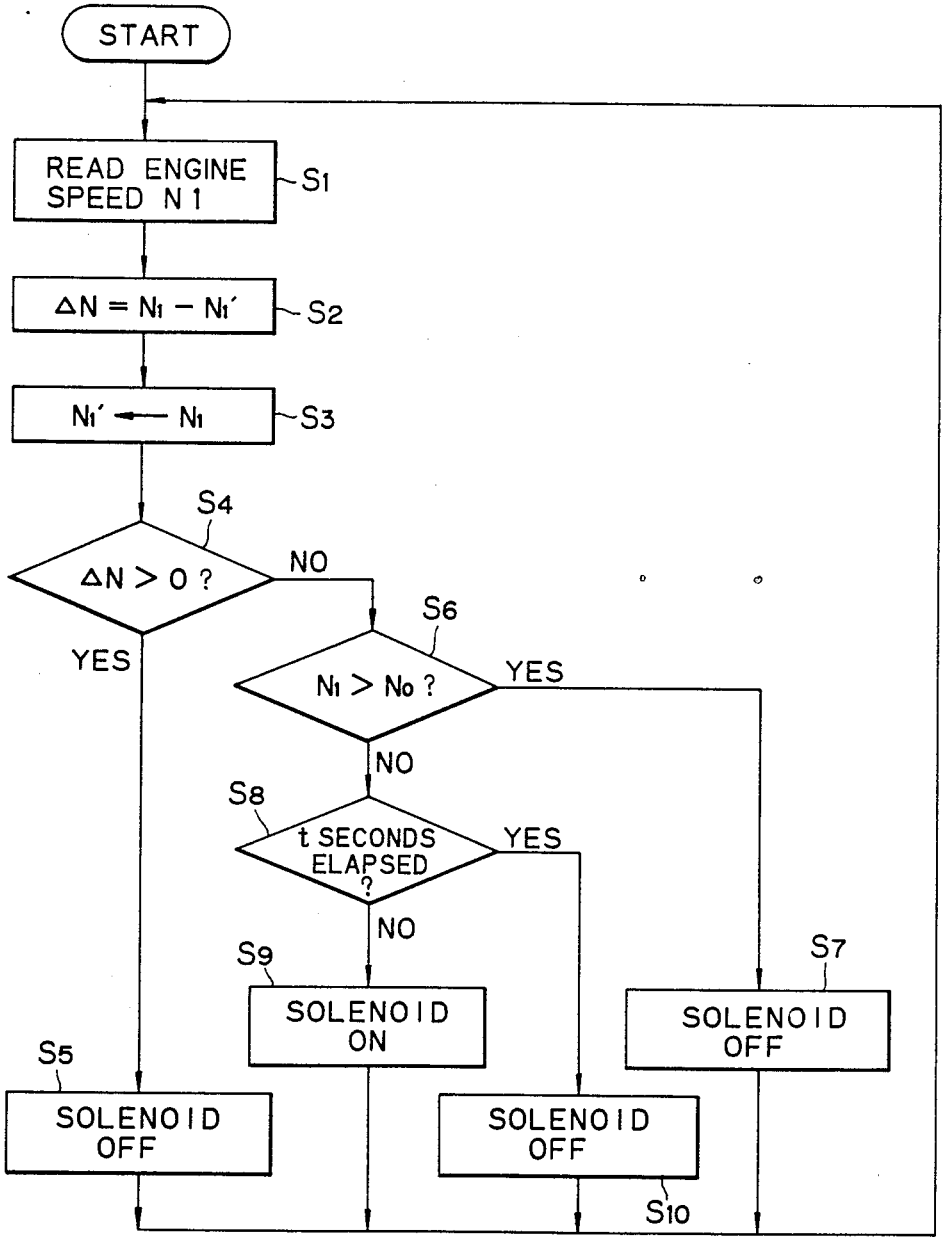
FIG. 4 is a flow chart illustrating operation of the reverse rotation preventing device shown in FIG. 3.

Operation of the reverse rotation preventing device is illustrated in the flow chart of FIG. 4. Referring to FIG. 4, a present detection value $N_1$ of the engine speed is read in at step $S_1$, and then at step $S_2$, a deviation $\Delta N$ between the present detection value $N_1$ and a preceding detection value $N_1'$ is calculated. Then at step $S_3$, the present detection value $N_1$ is updated as a preceding detection value $N_1'$ for comparison, and then, it is judged at step $S_4$ whether the deviation $\Delta N$ has a positive value or a negative value, that is, whether rotation of the engine is in an acceleration tendency or in a deceleration tendency. If an acceleration tendency is judged here, then a solenoid deenergizing instruction is developed at step $S_5$ as there is no possibility of stopping of the engine. On the contrary, if a deceleration tendency is judged at step $S_4$, then the detection value $N_1$ is compared at step $S_6$ with the reference value $N_0$, and then in case $N_1 < N_0$, a solenoid deenergizing instruction is developed at step $S_7$. On the other hand, if $N_1 < N_0$ at step $S_6$, it is considered that the engine 1 is in a stopping tendency, and the sequence thus advances by way of step $S_8$ to step $S_9$ at which a solenoid energizing instruction is developed. Such solenoid energizing instruction continues to be developed for a period of time of t seconds which is set in advance to the timer 10 shown in FIG. 3. Consequently, the engine 1 is stopped. After lapse of the preset period of time, a solenoid deenergizing instruction is developed at step $S_{10}$ to release the engine stopping interlock.

Having now fully described the invention, it will be apparent to one of ordinary skill in the art that many changes and modifications can be made thereto without departing from the spirit and scope of the invention as set forth herein.

What is claimed is:

1. A reverse rotation preventing device for a Diesel engine, comprising an engine stopping means for stopping said engine, an engine speed detecting means for detecting a speed of said engine, a comparing means for comparing a detection value developed from said engine speed detecting means with a reference value which is set in advance as a low engine speed with which stopping of said engine may be resulted, a judging means for judging in accordance with the detection value from said engine speed detecting means whether or not said engine is in a deceleration tendency, an outputting means operable in accordance with a result of the judgement by said judging means and a result of the comparison by said comparing means for outputting an engine stopping signal to said engine stopping means when the detection value is lower than the reference value and said engine is in a deceleration tendency, and a timer means for interrupting the outputting of the engine stopping signal after lapse of a predetermined interval of time.

* * * * *